US009559404B1

(12) United States Patent
Matsuoka

(10) Patent No.: US 9,559,404 B1
(45) Date of Patent: Jan. 31, 2017

(54) ANTENNA

(71) Applicant: Google Inc., Mountain View, CA (US)

(72) Inventor: Yoshimichi Matsuoka, Sunnyvale, CA (US)

(73) Assignee: Google Inc., Mountain View, CA (US)

( * ) Notice: Subject to any disclaimer, the term of this patent is extended or adjusted under 35 U.S.C. 154(b) by 408 days.

(21) Appl. No.: 14/282,127

(22) Filed: May 20, 2014

(51) Int. Cl.
*H01Q 1/24* (2006.01)
*H01Q 1/12* (2006.01)

(52) U.S. Cl.
CPC ..... *H01Q 1/1264* (2013.01); *H01Q 1/24* (2013.01)

(58) Field of Classification Search
None
See application file for complete search history.

(56) References Cited

U.S. PATENT DOCUMENTS 1,826,731 A * 10/1931 Chatham ..... G01C 9/20 33/377
5,278,725 A * 1/1994 Konno ..... G06F 1/1616 16/223
5,692,647 A * 12/1997 Brodie ..... B60S 5/02 136/291
6,029,359 A * 2/2000 Szumer ..... G01C 9/28 33/373
2001/0046258 A1* 11/2001 Wise ..... H01Q 1/084 375/219
2007/0251132 A1* 11/2007 Luoma ..... G09F 9/33 40/541
2009/0174203 A1* 7/2009 Kim ..... A45F 3/14 294/156
2015/0011268 A1* 1/2015 Charugundla .... H04W 52/0251 455/574

FOREIGN PATENT DOCUMENTS

CN 203300152 U * 11/2013

OTHER PUBLICATIONS

Machine translation of CN 203300152 U, Huang et al.*

* cited by examiner

*Primary Examiner* — Magali P Slawski
(74) *Attorney, Agent, or Firm* — Honigman Miller Schwartz and Cohn LLP

(57) ABSTRACT

An antenna includes a solar panel and a signal receiver panel pivotally coupled to and in electrical communication with the solar panel. The antenna also includes a level indicator disposed on the signal receiver panel. The level indicator indicates whether a top surface of the signal receiver panel is horizontally level with respect to a direction of gravity.

10 Claims, 15 Drawing Sheets

ANTENNA

TECHNICAL FIELD

This disclosure relates to antennas.

BACKGROUND

A communication network is a large distributed system for receiving information (e.g., a signal) and transmitting the information to a destination. Over the past few decades the demand for communication access has dramatically increased. Although conventional wire and fiber landlines, cellular networks, and geostationary satellite systems have continuously been increasing to accommodate the growth in demand, the existing communication infrastructure is still not large enough to accommodate the increase in demand. In addition, some areas of the world are not connected to a communication network and therefore cannot be part of the global community where everything is connected to the internet.

Satellites and high-altitude communication balloons can be used to provide communication services to areas where wired cables cannot reach. Satellites may be geostationary or non-geostationary. Geostationary satellites remain permanently in the same area of the sky as viewed from a specific location on earth, because the satellite is orbiting the equator with an orbital period of exactly one day. Non-geostationary satellites typically operate in low- or mid-earth orbit, and do not remain stationary relative to a fixed point on earth; the orbital path of a satellite can be described in part by the plane intersecting the center of the earth and containing the orbit.

Antennas for communication with satellites and high-altitude communication balloons generally include a satellite dish, which is a dish-shaped type of parabolic antenna designed to receive microwaves from communications satellites, which transmit data transmissions or broadcasts, such as satellite television.

SUMMARY

One aspect of the disclosure provides an antenna that includes a solar panel and a signal receiver panel pivotally coupled to and in electrical communication with the solar panel. The antenna also includes a level indicator disposed on the signal receiver panel. The level indicator indicates whether a top surface of the signal receiver panel is horizontally level with respect to a direction of gravity.

Implementations of the disclosure may include one or more of the following features. In some implementations, the antenna includes a coupler coupling the solar panel to the signal receiver panel. The coupler allows the solar panel to rotate between 0 degrees and 360 degrees about the coupler with respect to the signal receiver panel. In some examples, the coupler is a double hinge or a living hinge. Other types of coupling devices are possible as well.

In some implementations, the antenna includes a handle disposed on the coupler. The coupler may define a handle cavity that receives the handle. The handle can move between a stowed position, where the handle is received within the handle cavity, and a deployed position, where the handle is graspable (e.g., out of the cavity). Exemplary handles include collapsible or folding handles.

The solar panel and the signal receiver panel may be substantially square or rectangular shaped. Other shapes are possible as well, such a triangular, circular, polygonal, etc.

To facilitate mounting of the antenna, the solar panel or the signal receiver panel may define mounting holes proximate at least two adjacent corners of the respective panel. In some examples, the solar panel and the signal receiver panel define mounting holes proximate every corner to provide ample mounting options. Each mounting hole may receive a threaded rod. Moreover, the level indicator may be positioned proximate or coincident with a mounting hole defined proximate a corner of the signal receiver panel.

In some implementations, the solar panel includes a power storage device, such as a battery or a capacitor for storing at least some of the power generated by the solar panel. As such, the antenna may draw power from the power storage device when solar power is not available.

Another aspect of the disclosure provides a method of using an antenna. The method includes mounting at least one of a solar panel and a signal receiver panel of the antenna onto a support structure. The signal receiver panel is pivotally coupled to and in electrical communication with the solar panel. The method also includes positioning a top surface of the signal receiver panel horizontally level with respect to a direction of gravity and positioning the solar panel to receive sun light.

In some implementations, the method includes using a level indicator disposed on the signal receiver panel to position the top surface of the signal receiver panel horizontally level with respect to the direction of gravity. The level indicator may indicate an angle of inclination of the top surface of the signal receiver with respect to the direction of gravity.

The method may include pivoting the solar panel with respect to the signal receiver panel. A coupler (e.g., a double hinge or a living hinge) couples the solar panel to the signal receiver panel and allows the solar panel to rotate between 0 degrees and 360 degrees about the coupler with respect to the signal receiver panel.

In some examples, the method includes demounting the antenna from the support structure and pivoting the solar panel with respect to the signal receiver panel to move the antenna from an open position, where the solar panel and the signal receiver panel are arranged at an angle greater than zero with respect to each other, to a closed position, where the solar panel and the signal receiver panel are arranged at an angle of about zero with respect to each other. The method may also include carrying the antenna using a handle disposed on the coupler. The coupler may define a handle cavity; and the handle may move between a stowed position, where the handle is received within the handle cavity, and a deployed position, where the handle is graspable.

The step of mounting at least one of the solar panel and the signal receiver panel onto a support structure may include receiving a rod through at least one mounting hole defined by the solar panel or the signal receiver panel. The solar panel or the signal receiver panel may define mounting holes proximate at least two adjacent corners of the respective panel.

In some implementations, the method includes activating a power storage mode on the solar panel. During the power storage mode, the solar panel stores at least a fraction of power generated by the solar panel in a power storage device (e.g., a battery or capacitor).

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
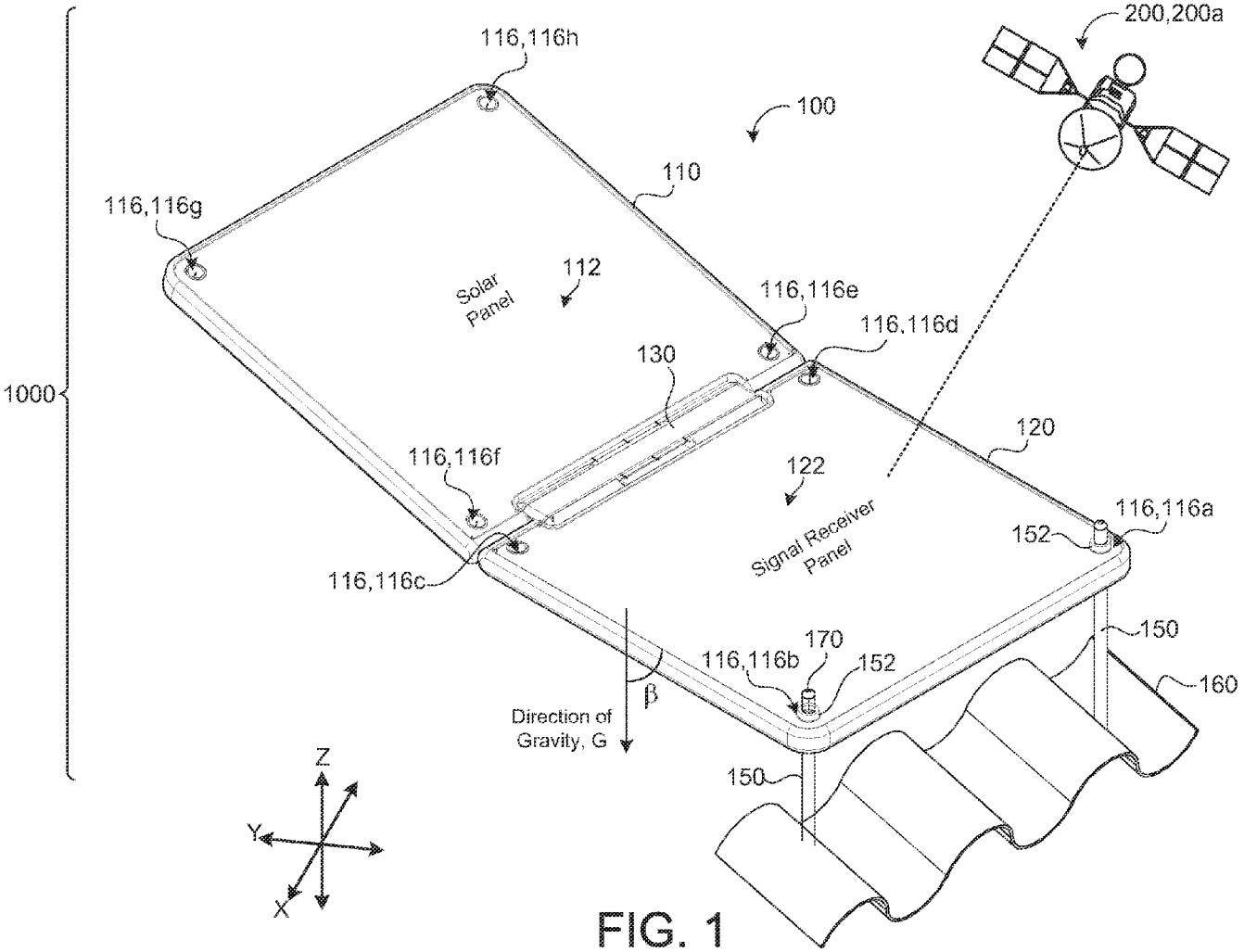
FIG. 1 is a top perspective view of an exemplary antenna communicating with a satellite as part of a communication system.

Referring to FIG. 1, in some implementations, a global-scale communication system 1000 includes an antenna 100 on earth in communication with High Altitude Communication Devices (HACD) 200, such as satellites 200*a*, orbiting earth. While traditional parabolic antennas may need somewhat precise or careful alignment for communications with a satellite 200*a*, flat array antennas 100 can be mounted level (with respect to gravity) to establish a communication link with a satellite 200*a*. Moreover, a portable antenna 100 (e.g., one that can be mounted, demounted, transported or stored, and remounted) provides greater use options, especially in situations where the antenna 100 may be used for discrete periods of time and then stored during no-usage.

Figure 10:
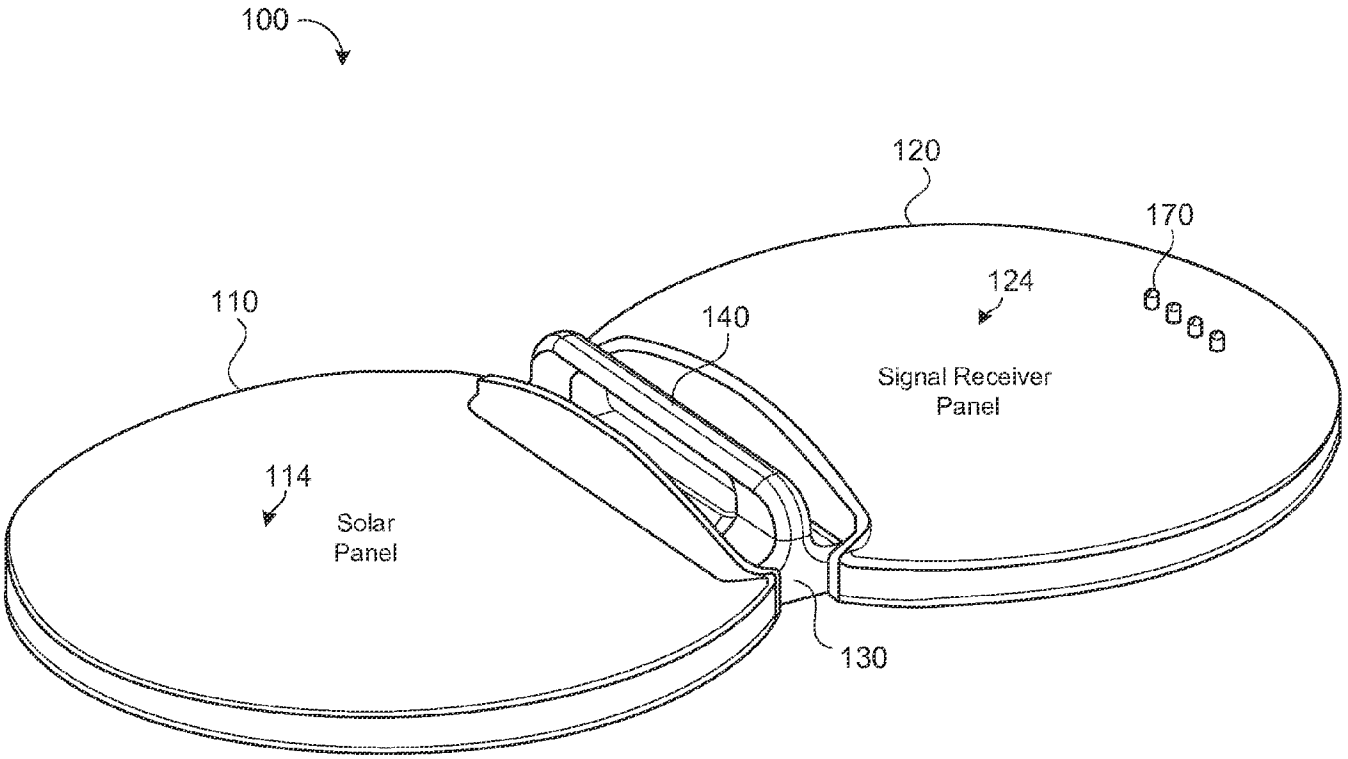
FIG. 10 is a perspective view of an exemplary antenna.

Referring to FIGS. 1-9, in some implementations, the antenna 100 includes a solar panel 110 and a signal receiver panel 120 pivotally coupled to and in electrical communication with the solar panel 110. In the examples shown in FIGS. 1-9, the solar panel 110 and the signal receiver panel 120 are both square shaped panels, while the example shown in FIG. 10 illustrates an antenna 100 with a substantially round solar panel 110 and a substantially round signal receiver panel 120. Other shapes of the solar panel 110 and the signal receiver panel 120 are possible as well, such as triangular, rectangular, polygonal, etc. Furthermore, one panel 110, 120 may have one shape, while the other panel 110, 120 has another shape.

In some implementations, the solar panel 110 is an assembly of solar cells or set of solar photovoltaic modules electrically connected and mounted on a supporting structure, where each photovoltaic module is a packaged, connected assembly of solar cells. A solar cell (also called a photovoltaic cell) is an electrical device that converts the energy of light directly into electricity by the photovoltaic effect. The solar cell may be a form of photoelectric cell (e.g., its electrical characteristics, such as current, voltage, or resistance, vary upon light incidence) which, when exposed to light, can generate and support an electric current without being attached to any external voltage source. The solar panel 110 delivers current to or otherwise powers the signal receiver panel 120.

The solar panel 110 may include a power storage device 118, such as a battery or a capacitor. While the solar panel 110 generates electricity, the power storage device 118 may store at least a fraction of the generated electricity (or power) for use by the antenna 100, when solar power generation is not available (e.g., at night).

The signal receiver panel 120 may be arranged to receive HACD communication signals, such as satellite communication signals (e.g., signals in the C-band (4-8 GHz), $K_u$-band (12-18 GHz), both, and/or other types of signals). In some implementations, the signal receiver panel 120 is a transceiver capable of transmitting to and receiving signals from an HACD 200 (e.g., a satellite 200*a*) orbiting the earth. The signal receiver panel 120 may be pointed toward a specific satellite 200, 200*a*. The signal receiver panel 120 may transmit uplinked signals within a specific frequency range, so as to be received by a transponder 210 tuned to that frequency range aboard the satellite 200, 200*a*. The transponder 210 may retransmit the signals back to earth, but at a different frequency band (a process known as translation, used to avoid interference with the uplink signal). Moreover, the signal receiver panel 120 may be configured to demodulate high quality video from received satellite signals. In some examples, the signal receiver panel 120 is between 0.5 inches and three inches thick (e.g., about one inch thick).

In some implementations, the antenna 100 includes a coupler 130 coupling the solar panel 110 to the signal receiver panel 120. The coupler 130 allows the solar panel 110 to rotate between 0 degrees and 360 degrees about the coupler 130 with respect to the signal receiver panel 120. In some examples, the coupler 130 is a double hinge (as shown in the examples); while in other examples, the coupler 130 is a living hinge. A living hinge is a flexible feature (flexure bearing) connecting two substantially rigid pieces that can rotate with respect to each other by virtue of the living hinge.

The solar panel 110 and the signal receiver panel 120 each have a front face 112, 122 and a rear face 114, 124. The solar panel 110 may receive light through its front face 112 and/or its rear face 114. Similarly, the signal receiver panel 120 may receive communication signals through its front face 122 and/or its rear face 124. The solar panel 110 and the signal receiver panel 120 are movable between a closed position (e.g., for storage) where the solar panel 110 and the signal receiver panel 120 contact each other (e.g., face-to-face) and an open position (e.g., for deployment and usage) with the solar panel 110 and the signal receiver panel 120 arranged at angle θ with respect to each other. In some examples, the solar panel 110 and the signal receiver panel 120 contact each other back-to-back in the open position.

In some implementations, the antenna 100 includes a handle 140 disposed on or integral with the coupler 130. The handle 140 may be used to carry the antenna 100 while in the closed position and/or to position or orient the antenna 100 while in the open position. In the example shown in FIG. 9, the coupler 130 defines a handle cavity 132 that receives the handle 140. The handle 140 may move between a stowed position, where the handle 140 is received within the handle cavity 132, and a deployed position, wherein the handle 140 is away from the handle cavity 132 (e.g., in a graspable position). The handle 140 may be a folding handle or a collapsible handle that conforms to an overall shape of the coupler 130.

In the example shown in FIG. 10, the coupler 130 and the handle 140 are integral. In this configuration, movement of the solar panel 110 and the signal receiver panel 120 with respect to each other may be limited or obstructed by the handle 140. In some examples (not shown), one for each of the solar panel 110 and the signal receiver panel 120 define(s) a recess to receive the handle 140 when the solar panel 110 is rotated 360° with respect to the signal receiver panel 120 from the closed position to the open position (e.g., from face-to-face to back to back).

The front face 112 of the solar panel 110 may be arranged to receive light or solar radiation in order to generate electricity. Moreover, the front face 122 of the signal receiver panel 120 may be arranged to receive satellite communications. As such, the solar panel 110 and the signal receiver panel 120 may be rotated or pivoted with respect to each other via the coupler 130 to meet desired orientations of the two panels 110, 120.

The solar panel 110 and/or the signal receiver panel 120 may define mounting holes 116 proximate at least two adjacent corners of the respective panel 110, 120. Each mounting hole 116 may receive a threaded rod 150 for mounting the antenna 100 on a structure 160 (e.g., a pole, house, building, etc.). One or more nuts 152 threaded on the respective threaded rod 150 may secure the antenna 100 on the threaded rod 150 in a particular orientation or position. In the examples shown in FIGS. 1-9, the solar panel 110 and the signal receiver panel 120 each defines four mounting holes 116*a-h*, one near each corner of the respective panel 110, 120. The antenna 100 may be mounted on the structure 160 using any one or more mounting holes 116 (e.g., any two adjacent mounting holes 116).

A level indicator 170 may be disposed on the signal receiver panel 120. The level indicator 170 indicates whether the front face 122 (top surface) of the signal receiver panel 120 is horizontally level (e.g., in X and Y directions) with respect to a direction of gravity (Z direction). A level, also known as a spirit level or a bubble level is an instrument configured to indicate whether a surface is horizontal (level) or vertical (plumb). The level indicator 170 may include one or more vials (e.g., made of plastic or glass) filled with a liquid (e.g., an alcohol), while leaving a bubble inside. The bubble travels away from a neutral or level position when the level is inclined. A bull's eye level includes a circular, flat domed or convex vial filled with a liquid (e.g., an alcohol), while leaving a bubble inside. When the bull's eye level indicates whether a normal line (in a Z-direction) from a plane is vertical (plumb) (e.g., whether the plane is horizontal in two directions (X and Y directions). The level indicator 170 may be positioned proximate or coincident with a mounting hole 116 defined proximate a corner of the signal receiver panel 120. A level indicator 170 may be placed on the solar panel 110 as well, in order to determine an orientation or angle θ of the solar panel 110 with respect to the signal receiver panel 120.

The stowable nature of the antenna 100 (e.g., folding between a stowed/closed position and an open/deployed position) allows a user to mount and demount the antenna 100 from a structure, for example, to move the antenna 100 to another location to store the antenna 100 overnight, etc. Moreover, the mounting holes 116 are conducive for a number of mounting options and mounting configurations for the antenna 100.

Figure 2:
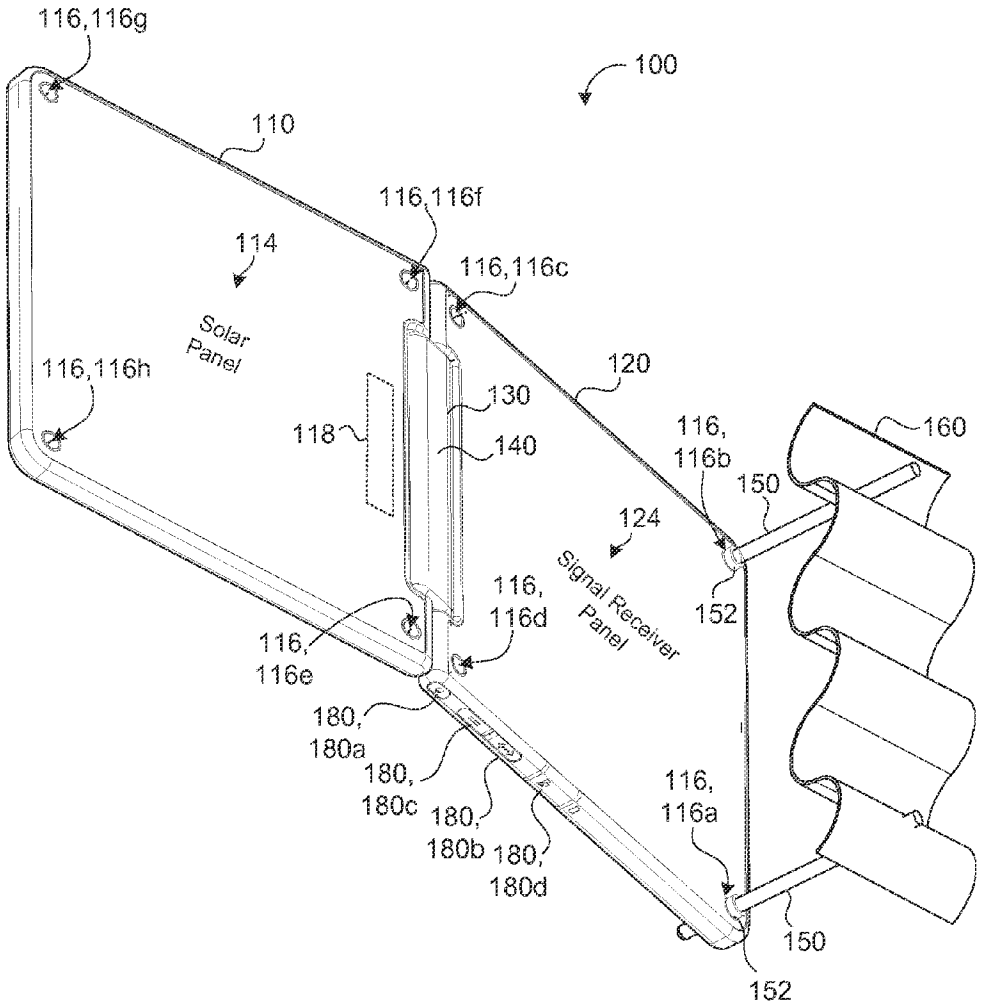
FIG. 2 is a bottom perspective view of the antenna shown in FIG. 1.
Figure 3:
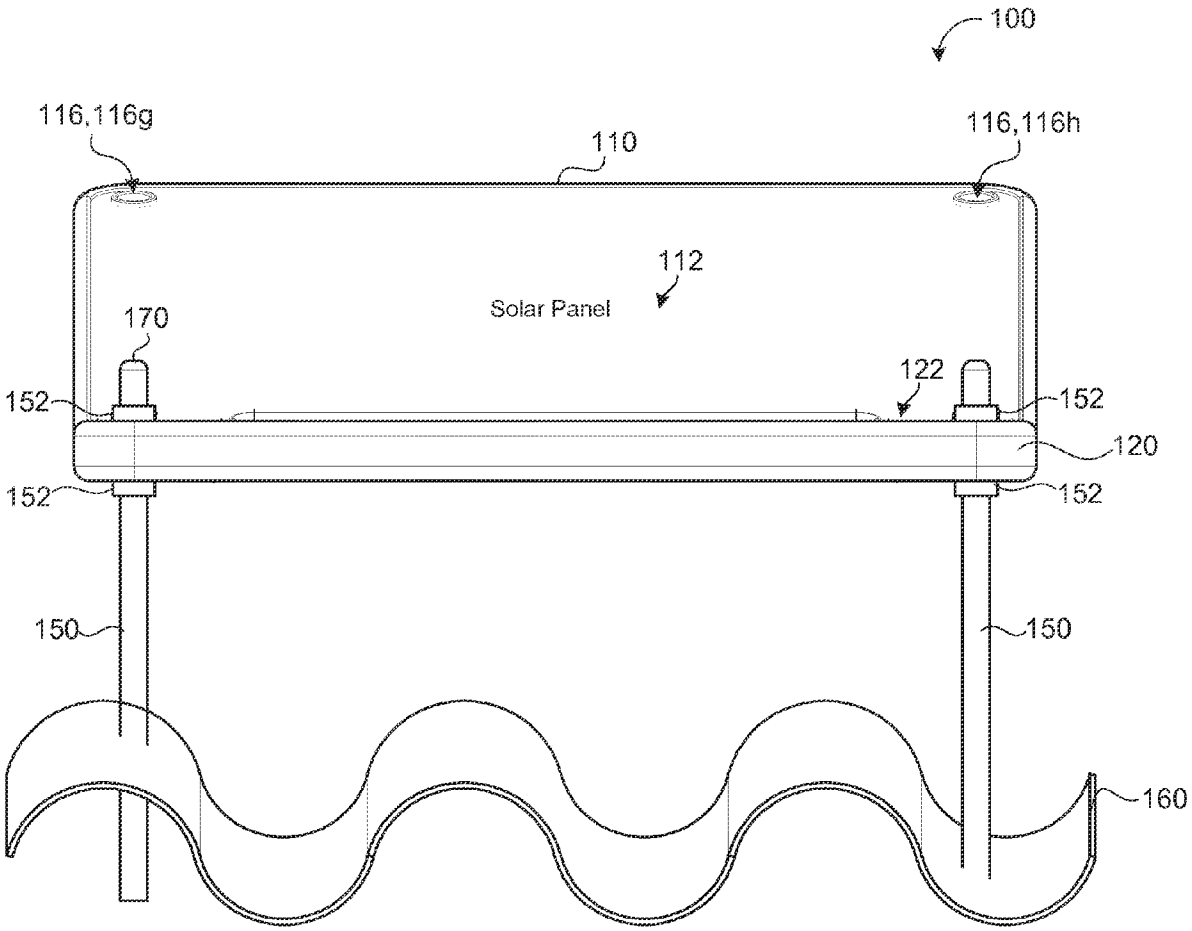
FIG. 3 is a front view of the antenna shown in FIG. 1.
Figure 4:
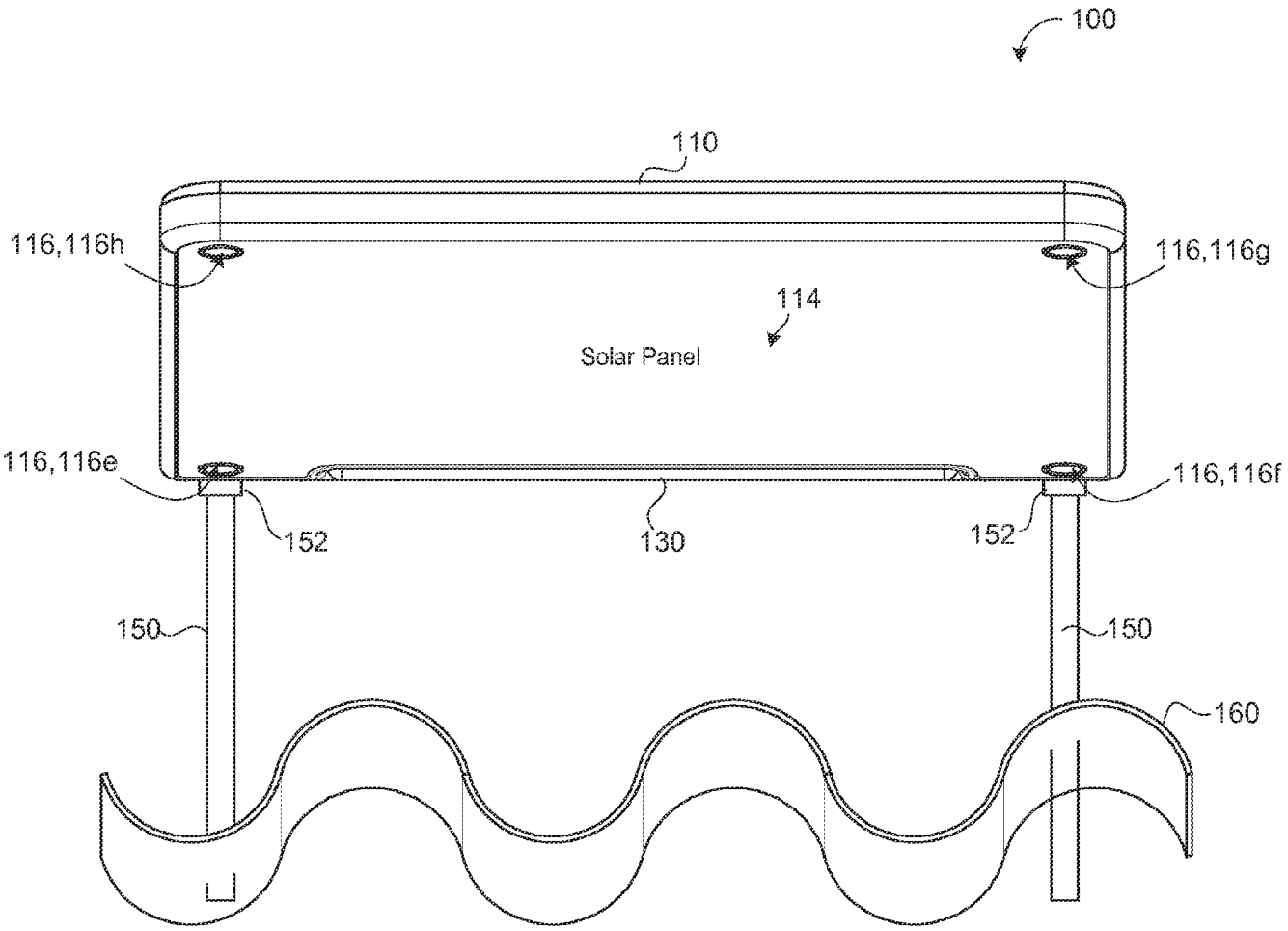
FIG. 4 is a rear view of the antenna shown in FIG. 1.
Figure 5:
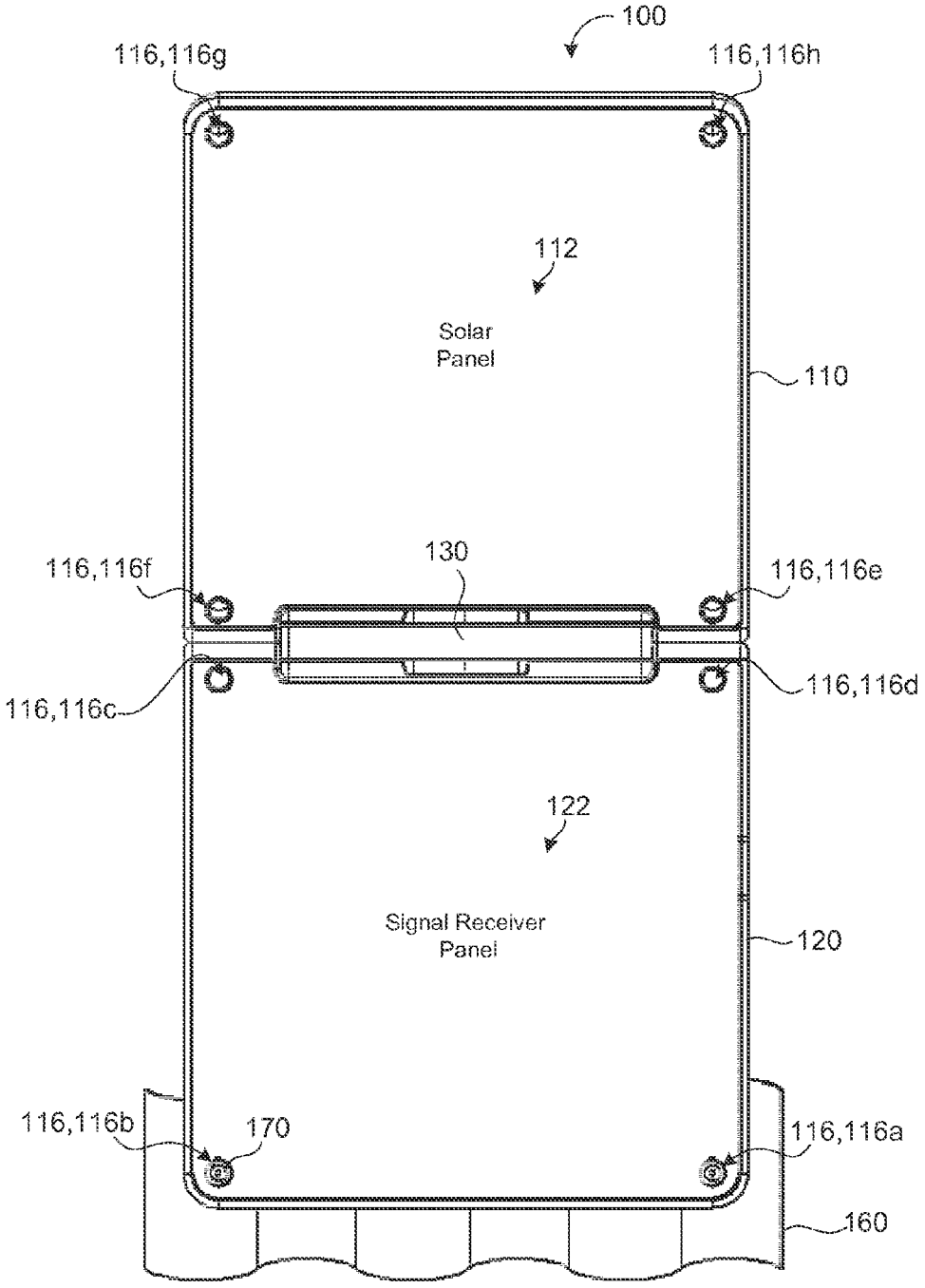
FIG. 5 is a top view of the antenna shown in FIG. 1.
Figure 6:
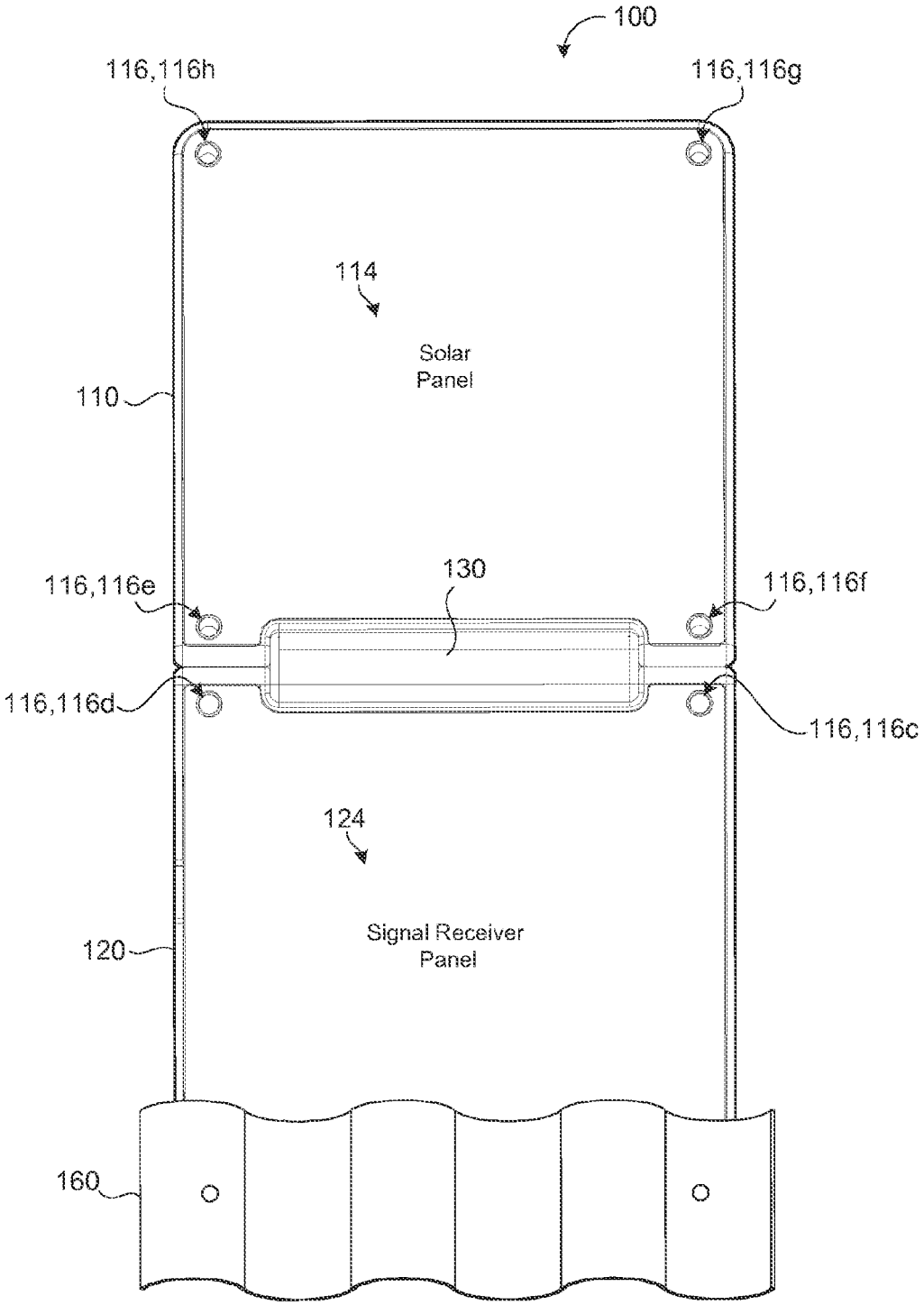
FIG. 6 is a bottom view of the antenna shown in FIG. 1.
Figure 7:
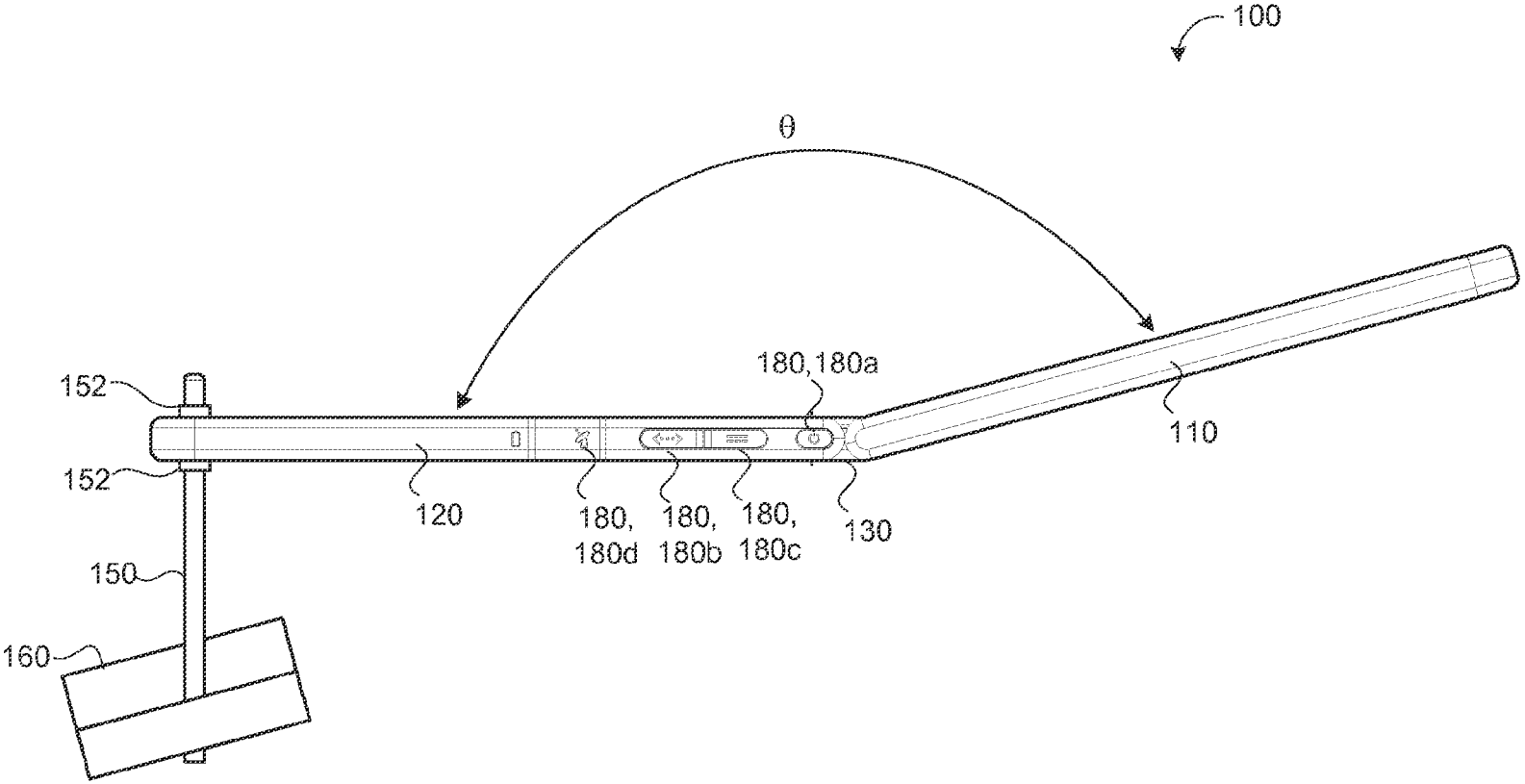
FIG. 7 is a side view of the antenna shown in FIG. 1.
Figure 8:
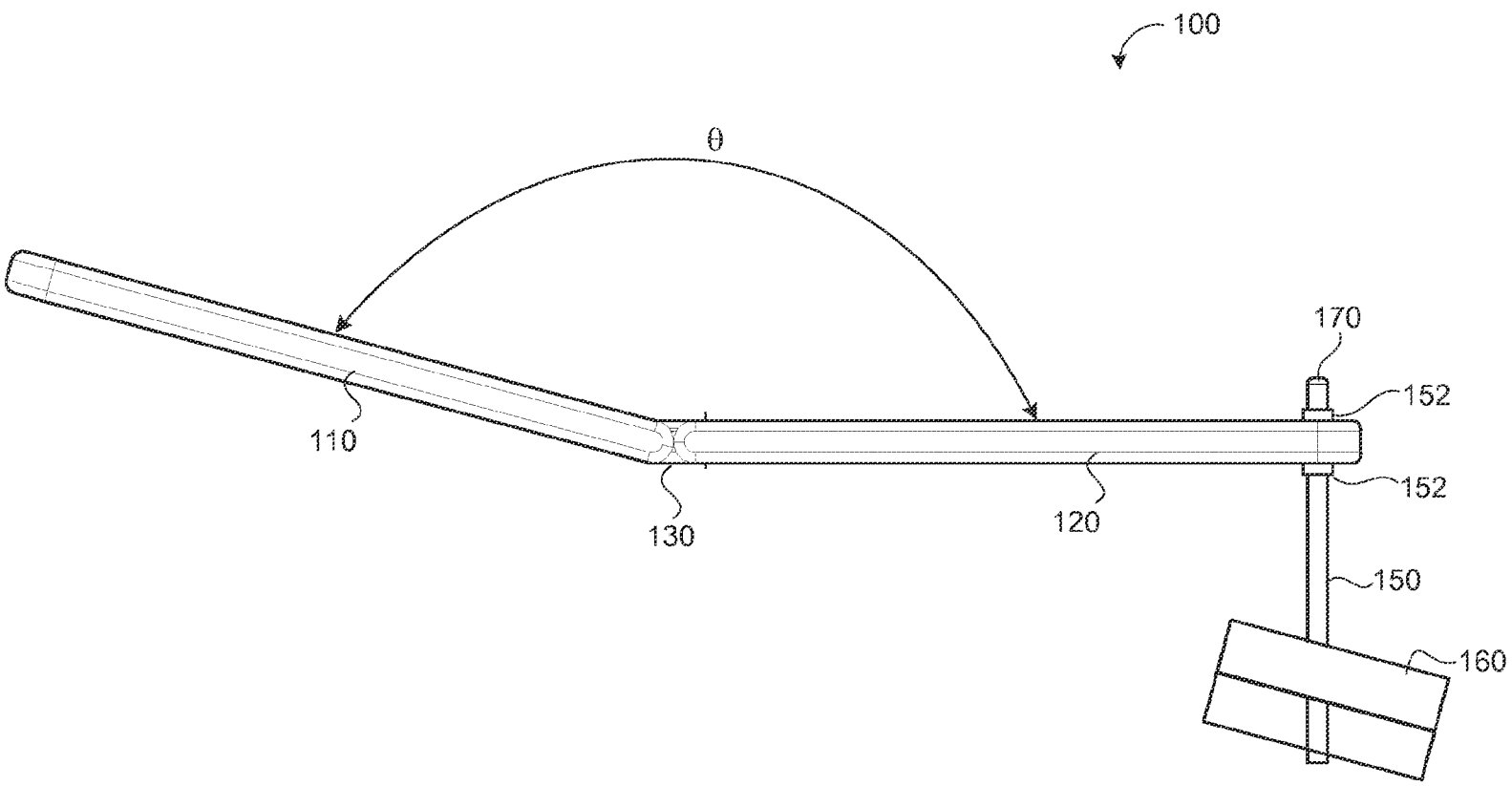
FIG. 8 is another side view of the antenna shown in FIG. 1.
Figure 9:
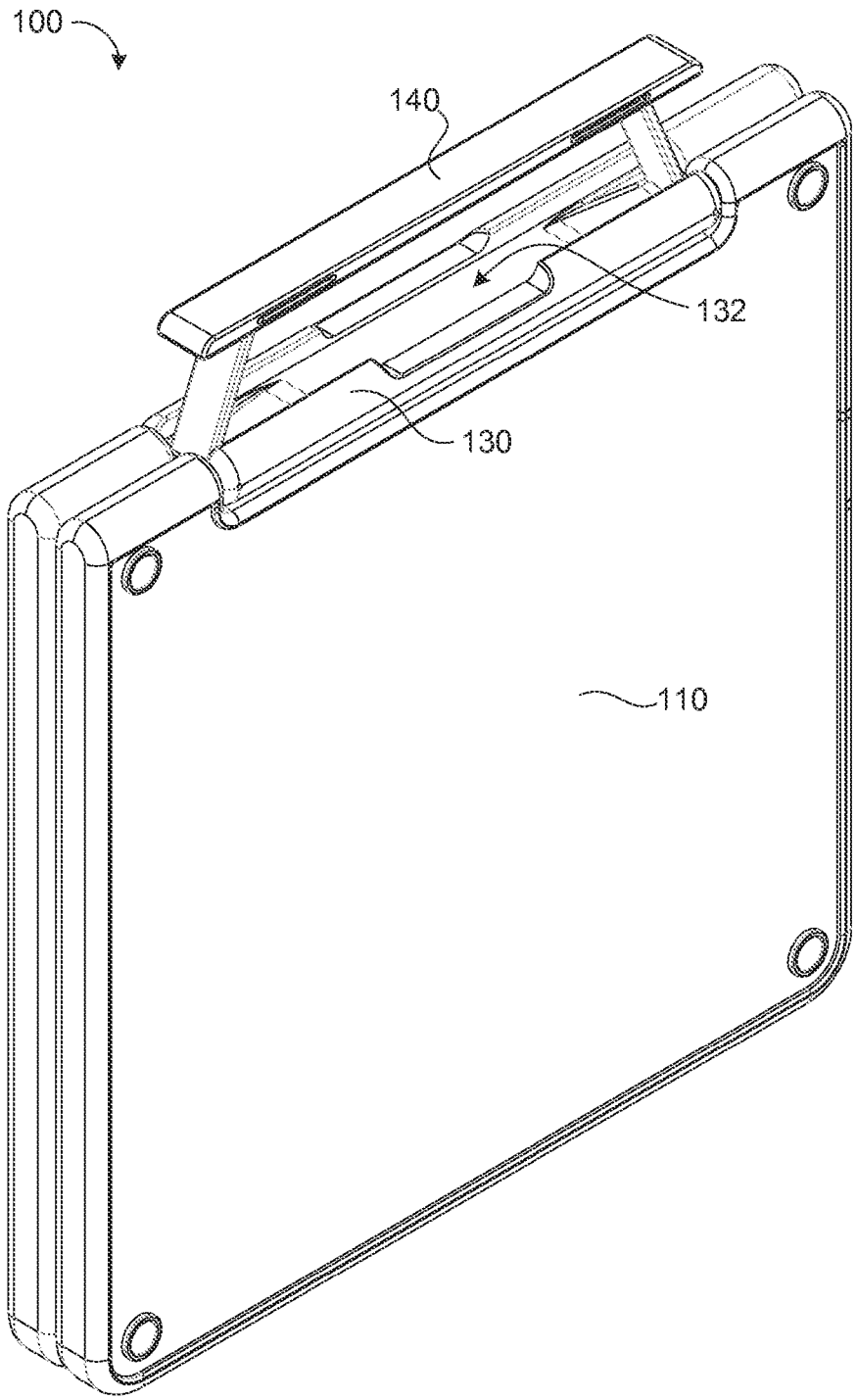
FIG. 9 is a perspective view of the antenna shown in FIG. 1 in a closed position.

Referring to FIGS. 2 and 7, in some examples, the antenna 100 includes one or more inputs 180 for user configuration of the antenna 100. In the example shown, the antenna 100 includes an on/off switch 180*a*, first and second input buttons 180*b*, 180*c*, and an uplink indicator 180*d* (e.g., a light emitting diode (LED) indicator). The on/off switch 180*a* may be used to activate and deactivate the solar panel 110 and/or the signal receiver panel 120. The first and/or second input buttons 180*b*, 180*c* may be used to set or select a communication bandwidth or communication protocol. Finally, the uplink indicator 180*d* may change color (e.g., from red to green) when the antenna 100 changes state from an unaligned position with a satellite 200*b* to an aligned position with the satellite 200*b*, establishing an uplink.

Figure 11:
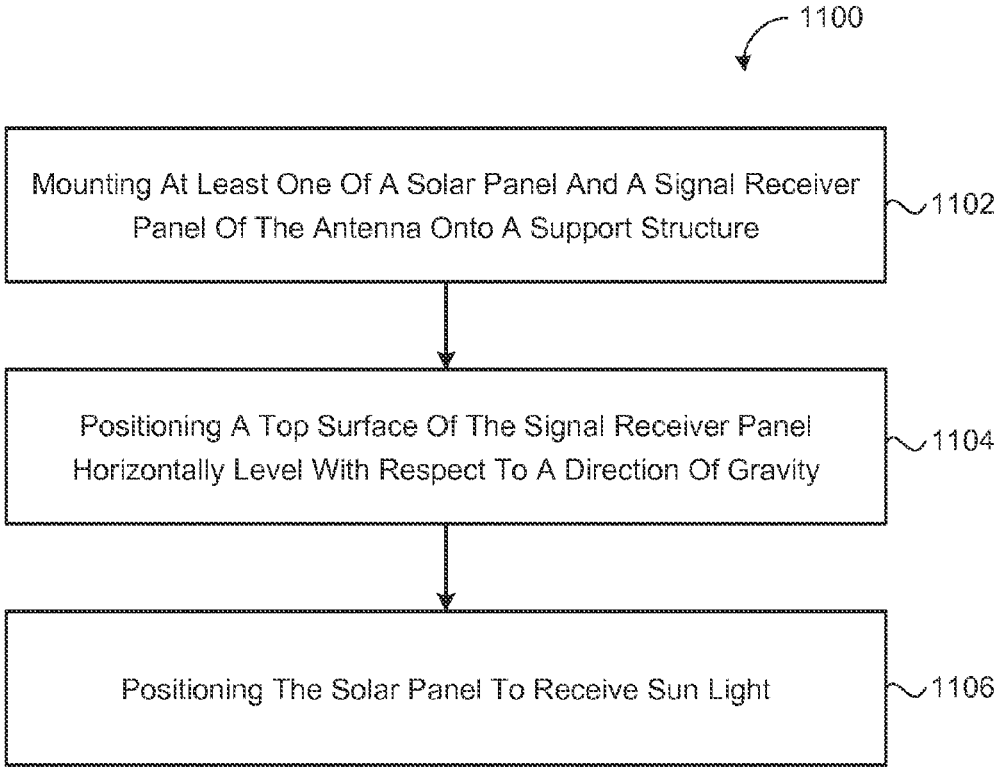
FIG. 11 is a schematic view of an exemplary arrangement of operations of a method of using an antenna.

FIG. 11 is a schematic view of an exemplary arrangement of operations of a method 1100 of using the antenna 100. The method 1100 includes mounting 1102 at least one of the solar panel 110 and the signal receiver panel 120 of the antenna 100 onto a support structure, such as a threaded rod 150 attached to a structure 160. The signal receiver panel 110 is pivotally coupled to and in electrical communication with the solar panel 120. The method 1100 also includes positioning 1104 a top surface 122 of the signal receiver panel 120 horizontally level with respect to a direction of gravity and positioning 1106 the solar panel 110 to receive sun light.

In some implementations, the method 1100 includes using the level indicator 170 disposed on the signal receiver panel 120 to position the top surface 122 of the signal receiver panel 120 horizontally level with respect to the direction of gravity. The level indicator 170 may indicate an angle of inclination β of the top surface 122 of the signal receiver 120 with respect to the direction of gravity G.

The method 1100 may include pivoting the solar panel 110 with respect to the signal receiver panel 120. As described earlier, a coupler 130 (e.g., a double hinge or a living hinge) couples the solar panel 110 to the signal receiver panel 120 and allows the solar panel 110 to rotate between 0 degrees and 360 degrees about the coupler 130 with respect to the signal receiver panel 120.

In some examples, the method 1100 includes demounting the antenna 100 from the support structure 150, 160 and pivoting the solar panel 110 with respect to the signal receiver panel 120 to move the antenna 100 from an open position, where the solar panel 110 and the signal receiver panel 120 are arranged at angle θ greater than zero with respect to each other, to a closed position, where the solar panel 110 and the signal receiver panel 120 are arranged at angle θ of about zero with respect to each other. The method 1100 may also include carrying the antenna 100 using a handle 140 disposed on the coupler 130. The coupler 130 may define a handle cavity 132; and the handle 140 may move between a stowed position, where the handle 140 is received within the handle cavity 132, and a deployed position, where the handle 140 is graspable.

The step of mounting at least one of the solar panel 110 and the signal receiver panel 120 onto a support structure 150, 160 may include receiving a rod 150 through at least one mounting hole 116 defined by the solar panel 110 or the signal receiver panel 120. The solar panel 110 or the signal receiver panel 120 may define mounting holes 116 proximate at least two adjacent corners of the respective panel 110, 120.

In some implementations, the method 1100 includes activating a power storage mode on the solar panel 110 (e.g., using one of the inputs 180). During the power storage mode, the solar panel 110 stores at least a fraction of power generated by the solar panel 110 in a power storage device 118 (e.g., a battery or capacitor).

Figure 12A:
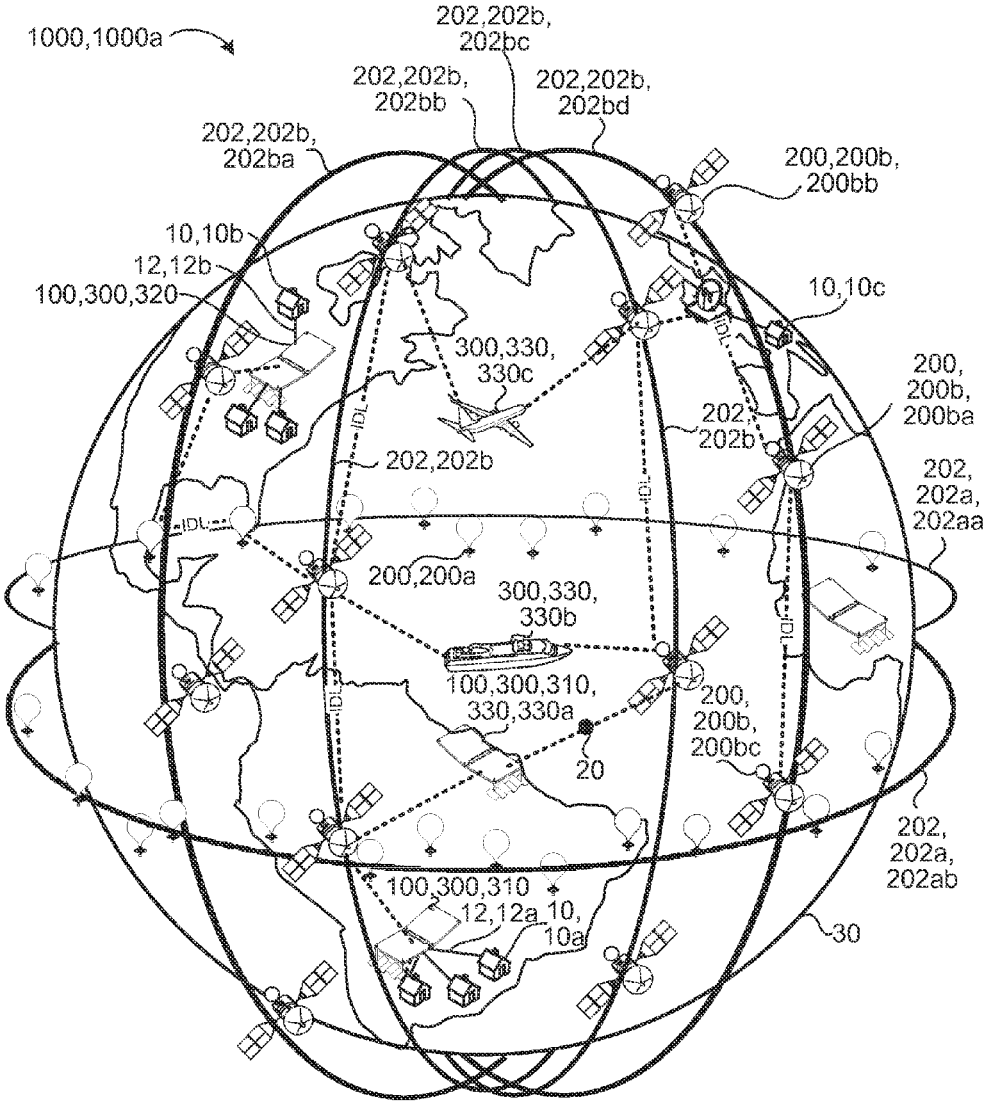
FIG. 12A is a schematic view of an exemplary global-scale communication system with satellites and communication balloons, where the satellites form a polar constellation.
Figure 12B:
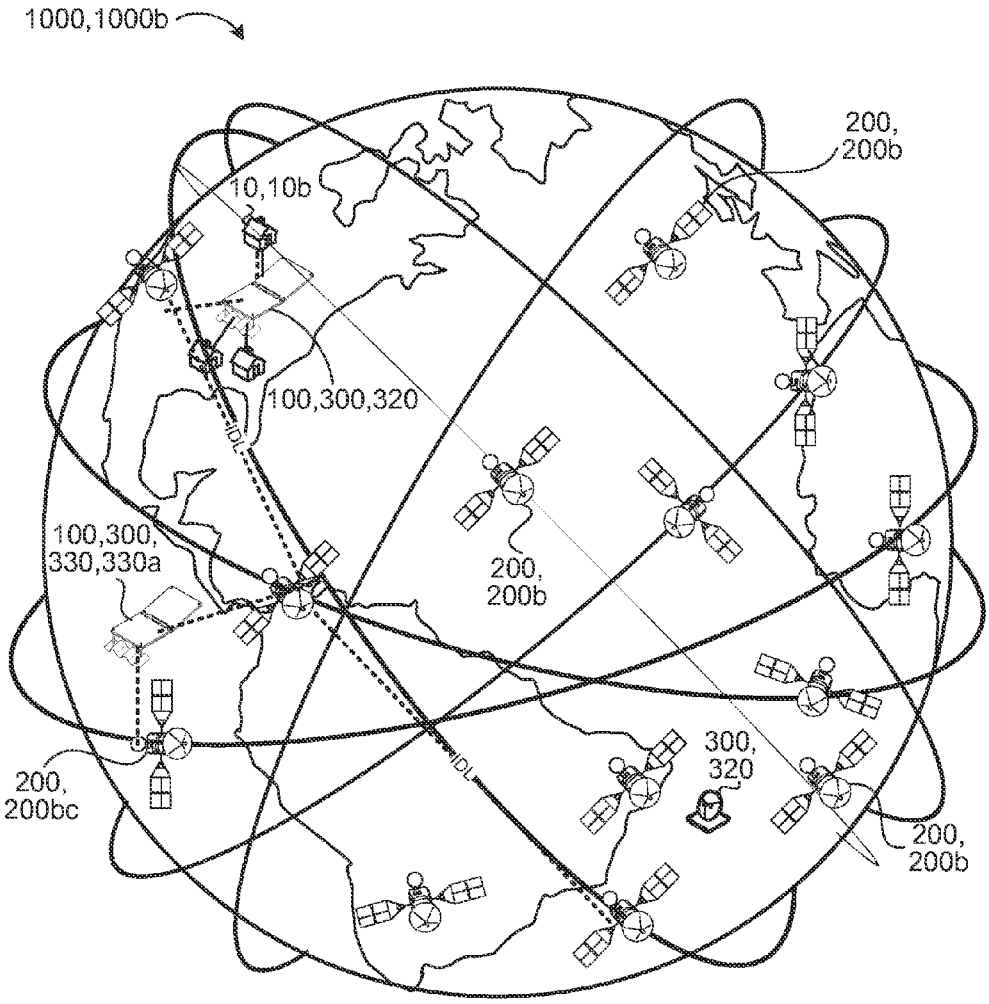
FIG. 12B is a schematic view of an exemplary group of satellites forming a Walker constellation.

Referring to FIGS. 12A and 12B, in some implementations, the global-scale communication system 1000 includes antennas 100 in communication with High Altitude Communication Devices (HACD) 200. Antennas 100 may be disposed on a user premises and/or on gateways 300 (including source ground stations 310, destination ground stations 320, and linking-gateways 330). In some examples, the source ground stations 310 and/or the destination ground stations 320 are user terminals or gateways 300 connected to one or more user terminals. An HACD 200 is a device released into the earth's atmosphere. HACD 200 may refer to a communication balloon 200*a* or a satellite 200*b* in Low Earth Orbit (LEO) or Medium Earth Orbit (MEO) or High Earth Orbit (HEO), including Geosynchronous Earth Orbit (GEO). The HACD 200 includes an antenna 207 that receives a communication 20 from a source ground station 310 and reroutes the communication signal to a destination ground station 320. The HACD 200 also includes a data processing device 210 that processes the received communication 20 and determines a path of the communication 20 to arrive at the destination ground station 320. The global-scale communication system 1000 may include communication balloons 200*a*, satellites 200*b*, or a combination of both as shown in FIG. 12A. Additionally, the global-scale communication system 1000 includes multiple ground stations 300, such as a source ground station 310, a destination ground station 320, and a linking-gateway 330. The source ground station 310 is in communication with a first user 10*a* through a cabled, a fiber optic, or a wireless radio-frequency connection 12*a*, and the destination ground station 320 is in communication with the second user 10*b* through a cabled, a fiber optic, or a wireless radio-frequency connection 12*b*. In some examples, the communication between the source ground station 310 and the first user 10*a* or the communication between the destination ground station 320 and the second user 10*b* is a wireless communication (either radio-frequency or free-space optical).

The HACDs 200 are divided into groups 202, with each group 202 (also referred to as a plane, since their orbit or trajectory may approximately form a geometric plane) having an orbital path or trajectory different than other groups 202. For example, the balloons 200*a* as the HACDs 200 rotate approximately along a latitude of the earth 30 (or in a trajectory determined in part by prevailing winds) in a first group or plane 202*aa* and along a different latitude or trajectory in a second group or plane 202*ab*. Similarly, the satellites 200*b* may be divided into a first group or plane 202*ba* and a second group or plane 202*bb*. The satellites 200*b* may be divided into a larger or smaller number of groups 202*b*.

The first user 10*a* may communicate with the second user in 10*b* or a third user 10*c*. Since each user 10 is in a different location separated by an ocean or large distances, a communication 20 is transmitted from the first user 10*a* through the global-scale communication system 1000 to reach its final destination, i.e., the second or third users 10*b*, 10*c*. Therefore, it is desirable to have a global-scale communication system 1000 capable of routing communication signal traffic over long distances, where one location is in a location far from a source or destination ground station 310, 320 (e.g., ocean) by allowing the communication 20 to travel along a path 22 (or link 22). In addition, it is desirable that the HACDs 200 and the gateways 300 of the global-scale communication system 1000 communicate amongst each other and between one another, without using complex free space architectures. Moreover, it is desirable to have a cost effective system. Therefore, it is important to reduce the cost of parts that allow such communications, which ultimately reduces the total weight and the size of the HACDs 200 and the gateways 300.

Communication balloons 200*a* are balloons filled with helium or hydrogen and are released in to the earth's stratosphere to attain an altitude between 11 to 23 miles, and provide connectivity for a ground area of 25 miles in diameter at speeds comparable to terrestrial wireless data services (such as 3G or 4G). The communication balloons 200*a* float in the stratosphere, at an altitude twice as high as airplanes and the weather (e.g., 20 km above the earth's surface). The high-altitude balloons 200*a* are carried around the earth 30 by winds and can be steered by rising or descending to an altitude with winds moving in the desired direction. Winds in the stratosphere are usually steady and move slowly at about 5 and 20 mph, and each layer of wind varies in direction and magnitude.

Figure 12D:
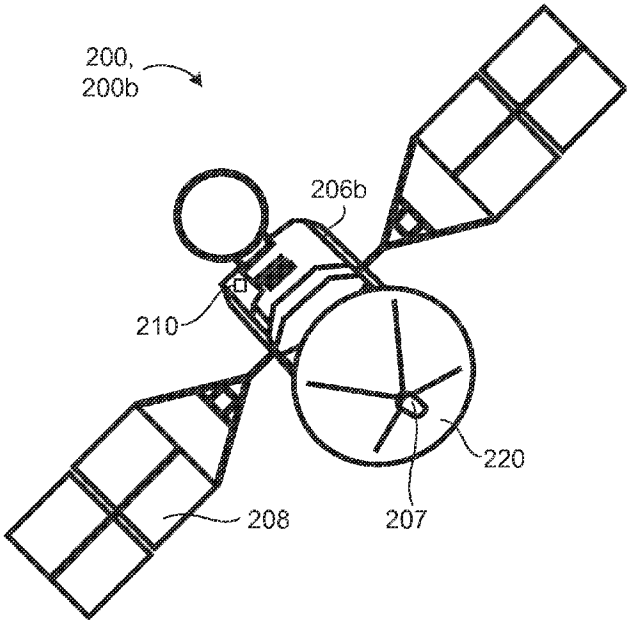
FIG. 12D is a perspective view of an exemplary satellite of the global-scale communication system.
Figure 12C:
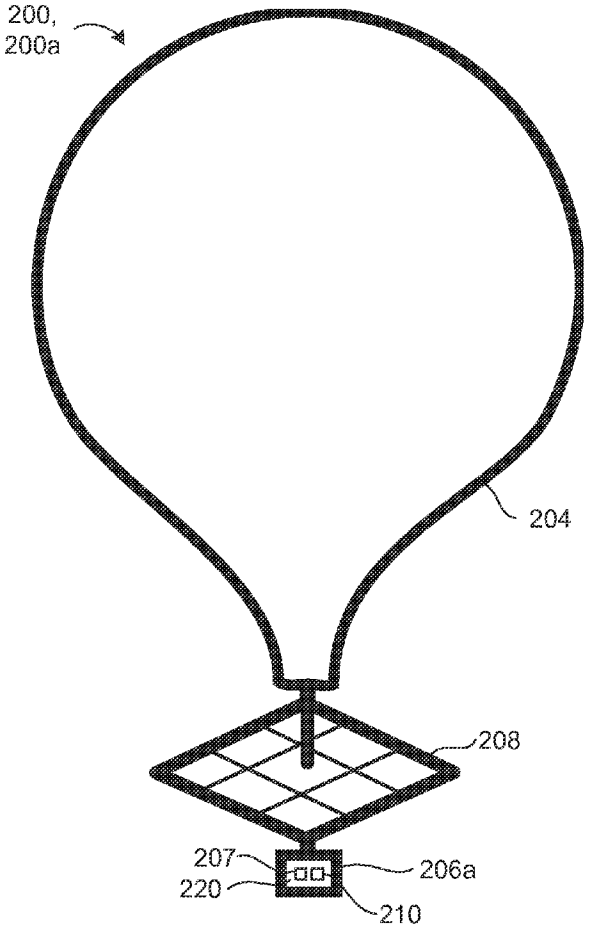
FIG. 12C is a perspective view of an exemplary communication balloon of the global-scale communication system.

Referring to FIG. 12C, the communication balloons 200*a* include a balloon 204 (e.g., sized about 49 feet in width and 39 feet in height), an equipment box 206*a*, and solar panels 208. The equipment box 206*a* includes a data processing device 210 that executes algorithms to determine where the high-altitude balloon 200*a* needs to go, then each high-altitude balloon 200*a* moves into a layer of wind blowing in a direction that will take it where it should be going. The equipment box 206*a* also includes batteries to store power and a transceiver 220 in communication with the data processing device 210. The transceiver 220 receives and transmits signals from/to other balloons 200*a* or internet antennas on the ground or gateways 300. The communication balloons 200*a* also include solar panels 208 that power the equipment box 206*a*. In some examples, the solar panels 208 produce about 100 watts in full sun, which is enough to keep the communication balloons 200*a* running while charging the battery and is used during the night when there is no sunlight. When all the high-altitude balloons 200*a* are working together, they form a balloon constellation. In some implementations, users 10 on the ground have specialized antennas that send communication signals to the communication balloon 200*a* eliminating the need to have a source or destination ground station 310, 320. The communication balloon 200*a* receiving the communication 20 sends the communication 20 to another communication balloon 200*a* until one of the communication balloons 200*a* is within reach of a destination ground station 320 that connects to the local internet provider and provides service to the user 10 via the network of balloons 200*a*.

Referring to FIG. 12D, a satellite 200*b* is an object placed into orbit around the earth 30 and may serve different purposes, such as military or civilian observation satellites, communication satellites, navigations satellites, weather satellites, and research satellites. The orbit of the satellite 200*b* varies depending in part on the purpose the satellite 200*b* is being used for. Satellite orbits may be classified based on their altitude from the surface of the earth 30 as Low Earth Orbit (LEO), Medium Earth Orbit (MEO), and High Earth Orbit (HEO). LEO is a geocentric orbit (i.e., orbiting around the earth 30) that ranges in altitude from 0 to 1,240 miles. MEO is also a geocentric orbit that ranges in altitude from 1,200 mile to 22,236 miles. HEO is also a geocentric orbit and has an altitude above 22,236 miles. Geosynchronous Earth Orbit (GEO) is a special case of HEO. Geostationary Earth Orbit (GSO, although sometimes also called GEO) is a special case of Geosynchronous Earth Orbit.

Multiple satellites 200*b* working in concert form a satellite constellation. The satellites 200*b* within the satellite constellation may be coordinated to operate together and overlap in ground coverage. Two common types of constellations are the polar constellation (FIG. 12A) and the Walker constellation (FIG. 12B), both designed to provide maximum earth coverage while using a minimum number of satellites 200*b*. The system 1000*a* of FIG. 12A includes the satellites 200*b* arranged in a polar constellation that covers the entire earth 30 and orbits the poles, while the system 1000*b* of FIG. 12B includes satellites 200*b* arranged in a Walker constellation that covers areas below certain latitudes, which provides a larger number of satellites 200*b* simultaneously in view of a user 10 on the ground (leading to higher availability, fewer dropped connections).

Referring to FIG. 12D, a satellite 200*b* includes a satellite body 206*b* having a data processing device 210, similar to the data processing device 210 of the communication balloons 200*a*. The data processing device 210 executes algorithms to determine where the satellite 200*b* is heading. The satellite 200*b* includes a transceiver 220 that receives and transmits signals from/to other satellites 200*b* or internet antennas on the ground or gateways 300. The satellite 200*b* includes solar panels 208 mounted on the satellite body 206*b*. The solar panels 208 provide power to the satellite 200*b*. In some examples, the satellite 200*b* includes rechargeable batteries used when sunlight is not reaching and charging the solar panels 208.

When constructing a global-scale communications system 1000 from multiple HACDs 200, it is sometimes desirable to route traffic over long distances through the system 1000 by linking one HACD 200 to another or to a gateway 300. For example, two satellites 200*b*, two balloons 200*a*, or a satellite 200*b* and a balloon 200*a* may communicate via optical links 22. In some examples, optical links 22 between two similar devices are called inter-device links (IDL) 22. In addition, HACDs 200 and gateways 300 may communicate using optical links 22. In such case, the gateways 300 may also include a transceiver 220 or other component capable of communicating with the transceiver 220 (of the communication balloon 200*a* or the satellite 200*b*). Such optical links 22 are useful to provide communication services to areas far from source and destination ground stations 310, 320 and may also reduce latency and enhance security.

In some implementations, long-scale HACD constellations (e.g., balloon constellation or satellite constellations) are described in terms of a number of planes or groups 202, and the number of HACDs 200 per plane 202. HACDs 200 within the same plane 202 maintain the same position relative to their intra-plane HACD 200 neighbors. However, the position of an HACD 200 relative to neighbors in an adjacent plane 202 varies over time. For example, in a large-scale satellite constellation with near-polar orbits, satellites 200*b* within the same plane 202*ba* (which corresponds roughly to a specific latitude, at a given point in time) (FIG. 12A) maintain a roughly constant position relative to their intra-plane neighbors (i.e., a forward and a rearward satellite 200*b*), but their position relative to neighbors in an adjacent plane 202*bb*, 202*bc*, 202*bd* varies over time. A similar concept applies to the communication balloons 200*a*; however, the communication balloons 200*a* rotate the earth 30 about its latitudinal plane and maintain roughly a constant position to its neighboring communication balloons 200*a* (see the balloon planes 202*aa*, 202*ab* in FIG. 12A).

Optical links 22 eliminate or reduce the number of HACDs 200 to gateway hops (due to the ability to link HACDs 200), which decreases the latency and increases the overall network capabilities. Optical links 22 allow for communication traffic from one HACD 200 covering a particular region to be seamlessly handed over to another HACD 200 covering the same region, where a first HACD 200 is leaving the first area and a second HACD 200 is entering the area.

A ground station 300 is usually used as a connector between HACDs 200 and the internet, or between HACDs 200 and users 10. Therefore, the combination of the HACD 200 and the gateways 300 provide a fully-connected global-scale communication system 1000 allowing any device to communicate with another device.

Figure 12E:
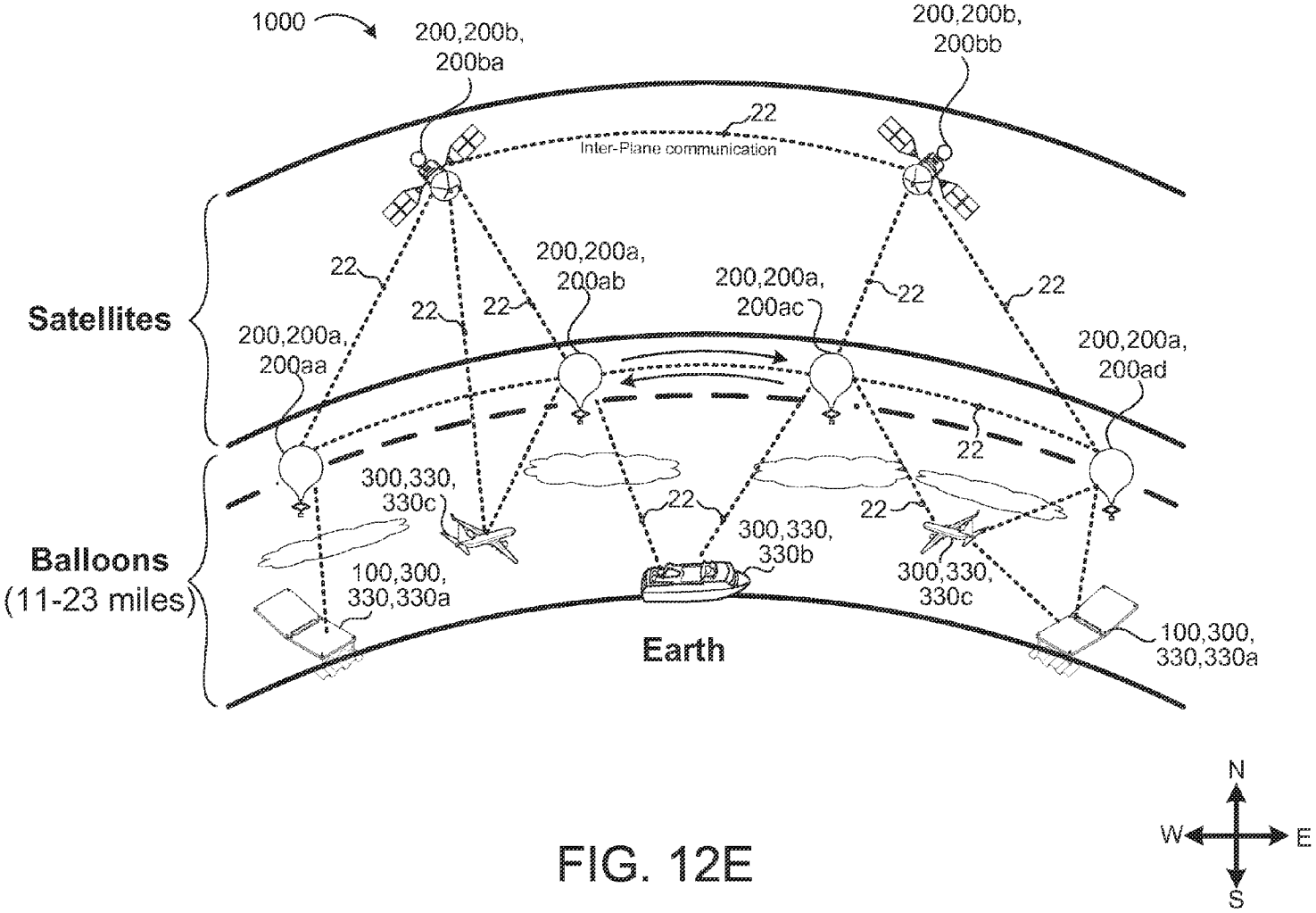
FIG. 12E is a schematic view of an exemplary global-scale communication system showing multiple devices communicating.

Referring to FIG. 12E, the linking-gateways 330 may be stationary linking-gateways 330*a* or a moving linking-gateway 330*b*, 330*c* (e.g., positioned on a moving object, such as an airplane, train, boat, or any other moving object). In some examples, a global-scale communication system 1000 includes a constellation of balloons 200*a*, a constellation of satellites 200*b*, gateways 300 (source ground station 310, destination ground station 320, and linking-gateway 330), each of which may communicate with the other. The figure shows multiple optical links 22 between the devices that may be possible. For example, the global-scale communication system 1000, as shown, includes two satellites 200*ba*, 200*bb*, four communication balloons 200*aa*, 200*ab*, 200*ac*, 200*ad*, and five gateways 300 (moving and stationary). Each of the shown devices 200, 300 may communicate with another device using the optical link 22 as long as the two devices are capable of seeing each other and emitting a communication 20 capable of being received by the other device 200, 300 (using the transceiver 220).

Various implementations of the systems and techniques described here can be realized in digital electronic and/or optical circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, non-transitory computer readable medium, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Implementations of the subject matter and the functional operations described in this specification can be implemented in digital electronic circuitry, or in computer software, firmware, or hardware, including the structures disclosed in this specification and their structural equivalents, or in combinations of one or more of them. Moreover, subject matter described in this specification can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The terms "data processing apparatus", "computing device" and "computing processor" encompass all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal, that is generated to encode information for transmission to suitable receiver apparatus.

A number of implementations have been described. Nevertheless, it will be understood that various modifications may be made without departing from the spirit and scope of the disclosure. Accordingly, other implementations are within the scope of the following claims.

What is claimed is:

1. An antenna comprising:

a solar panel;

a signal receiver panel having a front face and a rear face disposed on an opposite side of the signal receiver panel than the front face, the signal receiver panel pivotally coupled to and in electrical communication with the solar panel and configured to receive communication signals when the front face is horizontally level with respect to a direction of gravity, the signal receiver panel defining a mounting hole; and a level indicator disposed on the signal receiver panel at a location coincident with the mounting hole defined by the signal receiver panel, the level indicator indicating whether the front face of the signal receiver panel is horizontally level with respect to the direction of gravity, wherein the mounting hole defined by the signal receiver panel is configured to receive a mounting rod, the mounting rod mounting the antenna on a support structure.

2. The antenna of claim 1, further comprising a coupler coupling the solar panel to the signal receiver panel, the coupler allowing the solar panel to rotate between 0 degrees and 360 degrees about the coupler with respect to the signal receiver panel.

3. The antenna of claim 2, wherein the coupler comprises a double hinge or a living hinge.

4. The antenna of claim 2, further comprising a handle disposed on the coupler.

5. The antenna of claim 4, wherein the coupler defines a handle cavity, the handle movable between a stowed position, wherein the handle is received within the handle cavity, and a deployed position, wherein the handle is graspable.

6. The antenna of claim 1, wherein the solar panel and the signal receiver panel are substantially square or rectangular shaped.

7. The antenna of claim 1, wherein the solar panel defines mounting holes proximate at least two adjacent corners of the solar panel.

8. The antenna of claim 7, further comprising a threaded rod received by one of the mounting holes defined by the solar panel.

9. The antenna of claim 1, wherein the mounting rod received by the mounting hole defined by the signal receiver panel comprises a threaded rod.

10. The antenna of claim 1, wherein the solar panel comprises a power storage device.

* * * * *